US005862831A

United States Patent [19]

Chung et al.

[11] Patent Number: 5,862,831

[45] Date of Patent: Jan. 26, 1999

[54] VARIABLE-REGENERATION DIRECTIONAL CONTROL VALVE FOR CONSTRUCTION VEHICLES

[75] Inventors: Tae Seung Chung, Pusan; Yang Goo Lee, Changwon, both of Rep. of Korea

[73] Assignee: Volvo Construction Equipment Korea Co., Ltd., Rep. of Korea

[21] Appl. No.: 762,989

[22] Filed: Dec. 10, 1996

[30] Foreign Application Priority Data

May 21, 1996 [KR] Rep. of Korea ..... 96-17288

[51] Int. Cl.[6] ..... F15B 13/04

[52] U.S. Cl. ..... 137/596.2; 91/436

[58] Field of Search ..... 91/436; 137/596.2

[56] References Cited

U.S. PATENT DOCUMENTS 4,107,923 8/1978 Budzich ..... 91/436 X
4,303,091 12/1981 Hertell et al. ..... 137/596.13 X
4,339,927 7/1982 Sarcia .
4,642,019 2/1987 Sutton .
5,615,705 4/1997 Cho .

*Primary Examiner*—Gerald A. Michalsky
*Attorney, Agent, or Firm*—Harness, Dickey & Pierce, P.L.C.

[57] ABSTRACT

A variable-regeneration directional control valve for construction vehicles is disclosed. The control valve has a pressure control means for controlling the opposite pressure caused by elasticity of a valve spring. The opposite pressure acts on one end of a regeneration switching spool, while a self pressure (hydraulic pressure of pressurized fluid output from a pump) acts on the other end of the regeneration switching spool and thereby moves the spool. In the preferred embodiment, the means is a pressure control piston, which is provided on the end of the valve spring. The pressure control piston receives an outside control signal through an electronic proportional control valve and thereby continuously moves. The electronic proportional control valve outputs pressurized fluid in proportion to a current amount of the outside control signal.

4 Claims, 3 Drawing Sheets

VARIABLE-REGENERATION DIRECTIONAL CONTROL VALVE FOR CONSTRUCTION VEHICLES

BACKGROUND OF THE INVENTION

1. Field of the Invention

The present invention relates, in general, to a variable-regeneration directional control valve used for controlling the flow of operating fluid relative to an actuator, such as a boom, arm or bucket cylinder, in a hydraulic circuit of a construction vehicle and, more particularly, to a structural improvement in such a valve for effectively selecting the return fluid regenerating function by an outside control signal.

2. Description of the Prior Art

In a hydraulic circuit for construction vehicles such as power excavators, "regeneration of fluid" means that return fluid in a return line extending from an actuator is fed back to a fluid supply line extending to the actuator, thereby preventing the generation of cavitation in the fluid supply line due to a shortage of pressurized fluid in the fluid supply line and smoothly regulating the moving speed of the actuator.

In order to regenerate the return fluid from an actuator in a construction vehicle's hydraulic circuit, it must be possible to selectively operate the actuator by the weight of an associated working member in place of pressurized fluid output from a hydraulic pump. For example, in the operation of a power excavator, return fluid under high pressure is obtained by the weight of a boom during a boom-down motion and in turn is used in a boom-up motion.

FIG. 1 is a view showing the construction of a directional control valve or arm control valve, which is used for controlling the flow direction of fluid for an arm cylinder and has a typical regeneration circuit. FIG. 2 is a circuit diagram showing the construction of a hydraulic circuit provided with the regeneration arm control valve of FIG. 1.

As shown in FIGS. 1 and 2, the arm cylinder ARM is connected to a hydraulic pump P through two fluid lines 101*a* and 101*b*. An arm control valve CV is mounted to the lines 101*a* and 101*b*. In the arm control valve CV, a spool linearly moves in a valve body in response to an operator's control signal 11, 31, thereby switching the internal lines of the valve CV and controlling the flow direction of fluid, which is supplied from the pump P to the arm cylinder ARM. The arm control valve CV thus starts or stops the arm cylinder ARM and controls the moving direction of the cylinder ARM. When the valve CV is switched into the neutral position, the internal lines except for the center bypass line 103 are closed, so that the pressurized fluid output from the pump P does not flow to the arm cylinder ARM but returns to the tank 53 through the bypass line 103.

In the regeneration arm control valve CV for the arm cylinder ARM repeatedly operated by the weight of the arm, a regeneration passage R is connected between a return passage CH and a tank passage T inside the valve block of the valve CV. Two lines 45 and 51 connect the regeneration passage R to the tank passage T. In a weight operation of the arm cylinder ARM, an orifice effect of an appropriate orifice cross-sectional area is formed between the above lines 45 and 51 thereby forming a pressure in the second fluid line 101*b*. In the above state, return fluid in the return passage CH is partially fed back to the large chamber of the cylinder ARM through a regeneration line 47, check valve 29 and fluid line 48.

The remaining return fluid in the return passage CH returns to the tank T through the lines 45 and 51.

While the arm cylinder ARM is operated by the weight of the arm, the moving speed of the cylinder ARM is influenced by the amount of return fluid. In the prior art, cavitation, which may be formed in the arm cylinder ARM, is thus prevented by forming a back pressure in the return line and by partially feeding the return fluid to the fluid supply line in order to partially regenerate the return fluid.

Particularly in an excavating work of a power excavator, a regeneration circuit and regeneration cancel circuit are selectively used during the operation of the excavator. That is, the pressure in the fluid supply line during an excavating work is increased during an arm-in motion, so that the back pressure caused by the orifice formed between the regeneration passage R and the tank passage T causes a pressure loss in the hydraulic circuit. Therefore, when the pressure or self pressure in the supply line is applied to the piston 24 through the line 49 and is higher than an opposite pressure caused by elasticity of the valve spring 25, the self pressure pushes the regeneration switching spool 22 of the valve CV to the right in FIG. 1. The spool 22 in the above position enlarges the cross-sectional area of the opening between the regeneration passage R and the tank passage T and thereby removes the orifice effect from the valve CV. The back pressure in the return line is thus reduced, thereby reducing the pressure loss in the hydraulic circuit during the excavating work.

However, in the regeneration cancel circuit using self pressure (pressure of operating fluid supplied from the pump P to the supply line of an actuator), the regeneration canceling operation is controlled by the difference of relative pressure between the self pressure applied to the pressure receiving area of the piston and the constant opposite pressure caused by elasticity of the valve spring.

Therefore, it is impossible to control either the regeneration circuit or the regeneration cancel circuit by an outside control signal, so that the regeneration canceling pressure cannot be appropriately controlled even if the pressure loss caused by the back pressure is reduced to an acceptable point.

However, during an excavating work of an excavator, it is preferable to appropriately change the regeneration canceling pressure in order to increase the regeneration canceling pressure. In the above case, the return fluid is forcibly regenerated, thus increasing the amount of the fluid in the supply line and thereby increasing the moving speed of the actuator during the excavating work. In addition, it is necessary to change the regeneration canceling pressure in order to reduce the regeneration canceling pressure. In the above state, the loss caused by the back pressure in the return passage is reduced and increases the excavating power of the excavator.

SUMMARY OF THE INVENTION

It is, therefore, an object of the present invention to provide a variable-regeneration directional control valve used in a hydraulic circuit of a construction vehicle in which the above problems can be overcome and which changes the regeneration canceling pressure, thereby effectively controlling the amount of regenerated fluid and regulating the moving speed of an actuator.

In order to accomplish the above object, the present invention provides a variable-regeneration directional control valve used in a hydraulic circuit of a construction vehicle, comprising a regeneration passage connected between a return passage and a tank passage, a check valve provided on the regeneration passage for preventing the reverse flow of fluid from a supply passage to the return passage through the regeneration passage, a regeneration switching spool movably arranged in a valve block between the regeneration passage and the tank passage in order to control a cross-sectional area of the fluid passage inside the control valve, the spool linearly moving in the valve block by the relation between a self pressure inside a supply line and an opposite pressure caused by elasticity of a valve spring, thus controlling the amount of regenerated fluid, further comprising a means for linearly moving in the control valve in response to an outside control signal and appropriately changing the opposite pressure caused by elasticity of the valve spring and thereby controlling a regeneration canceling pressure.

In the preferred embodiment, the means comprises a pressure control piston, which is provided on an end of the valve spring. The pressure control piston receives the outside control signal through an electronic proportional control valve and thereby continuously moves. The electronic proportional control valve outputs pressurized fluid in proportion to a current amount of the outside control signal.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
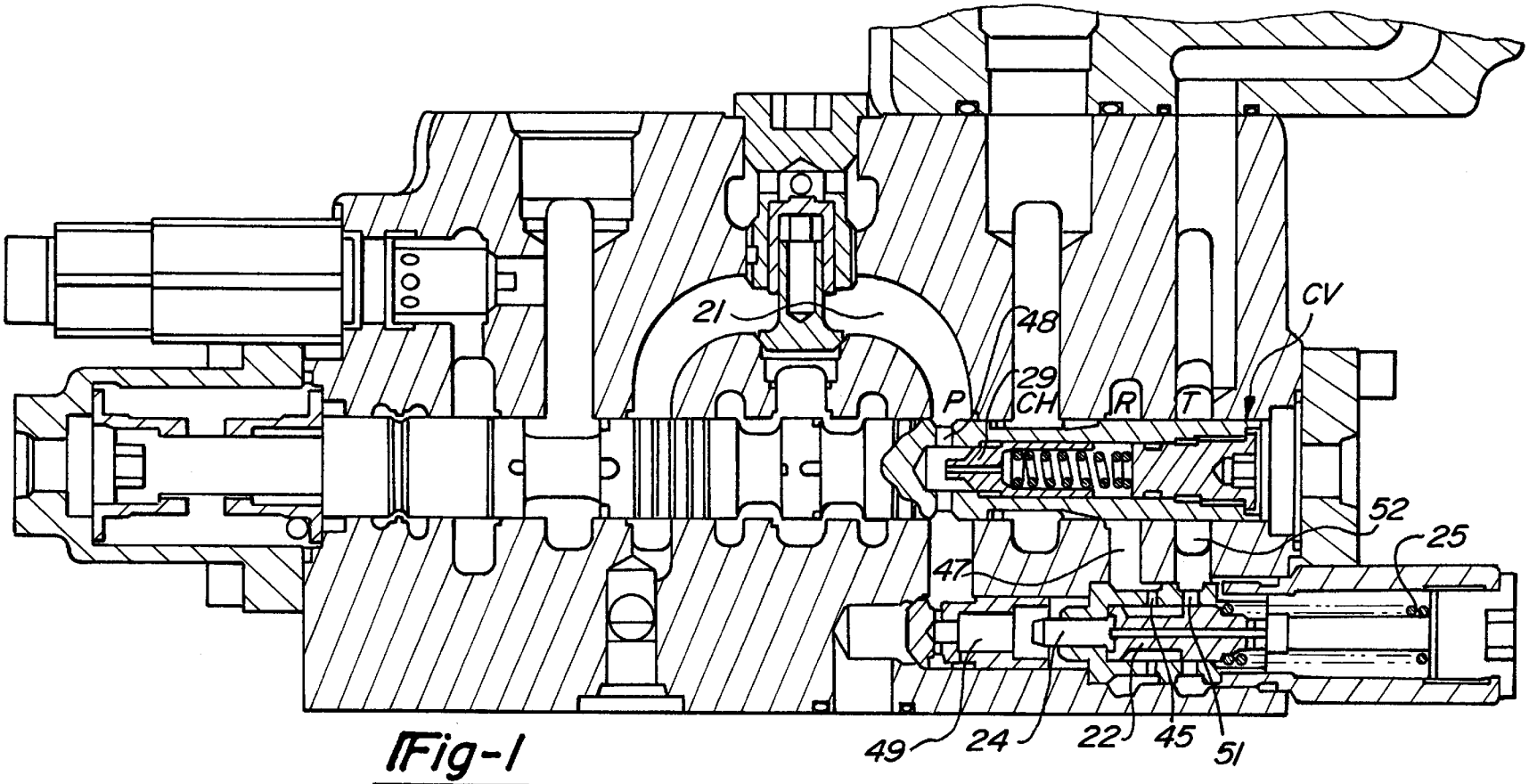
Fig-1 PRIOR ART
FIG. 1 is a view showing the construction of a directional control valve or arm control valve, which is used for controlling the flow direction of fluid for an arm cylinder and has a typical regeneration circuit.
Figure 2:
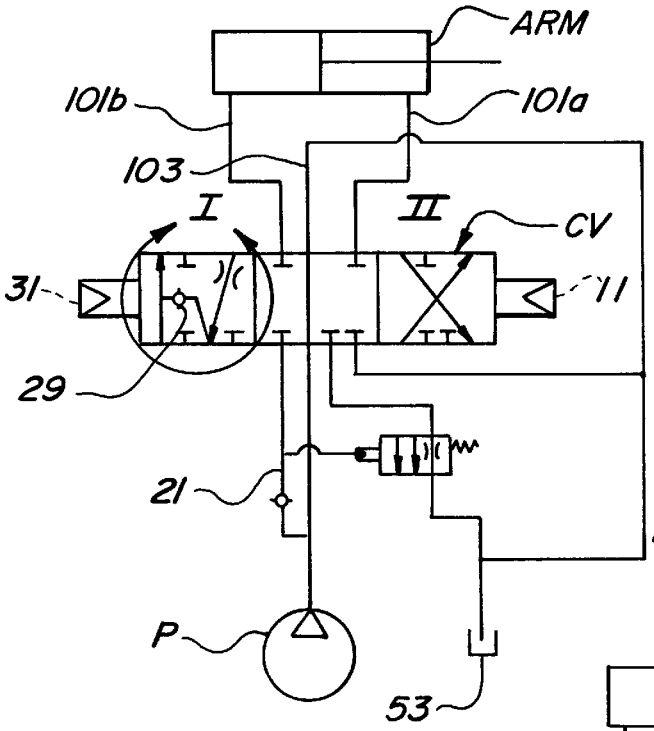
Fig-2 PRIOR ART
FIG. 2 is a circuit diagram showing the construction of a hydraulic circuit provided with the regeneration arm control valve of FIG. 1.

In the variable-regeneration directional control valve according to the present invention, most of the elements are common with those of the prior embodiment of FIGS. 1 and 2.

Those elements common to both valves according to the prior embodiment and the present invention will thus carry the same reference numerals and further explanation is not deemed necessary. In addition, the variable-regeneration control valve of this invention is used in, for example, an arm control valve of a power excavator in the following description. However, it should be understood that the control valve may be used in a boom control valve, bucket control valve or other directional control valve.

Figure 4:
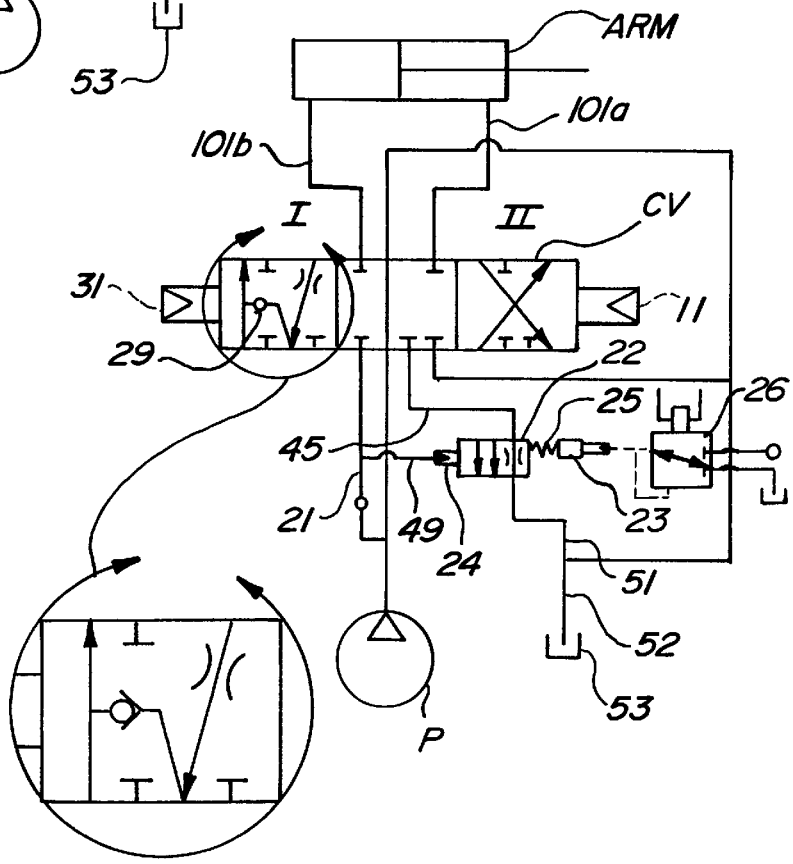
FIG. 4 is a circuit diagram showing the construction of the hydraulic circuit provided with the variable-regeneration arm control valve of FIG. 3.
Figure 3:
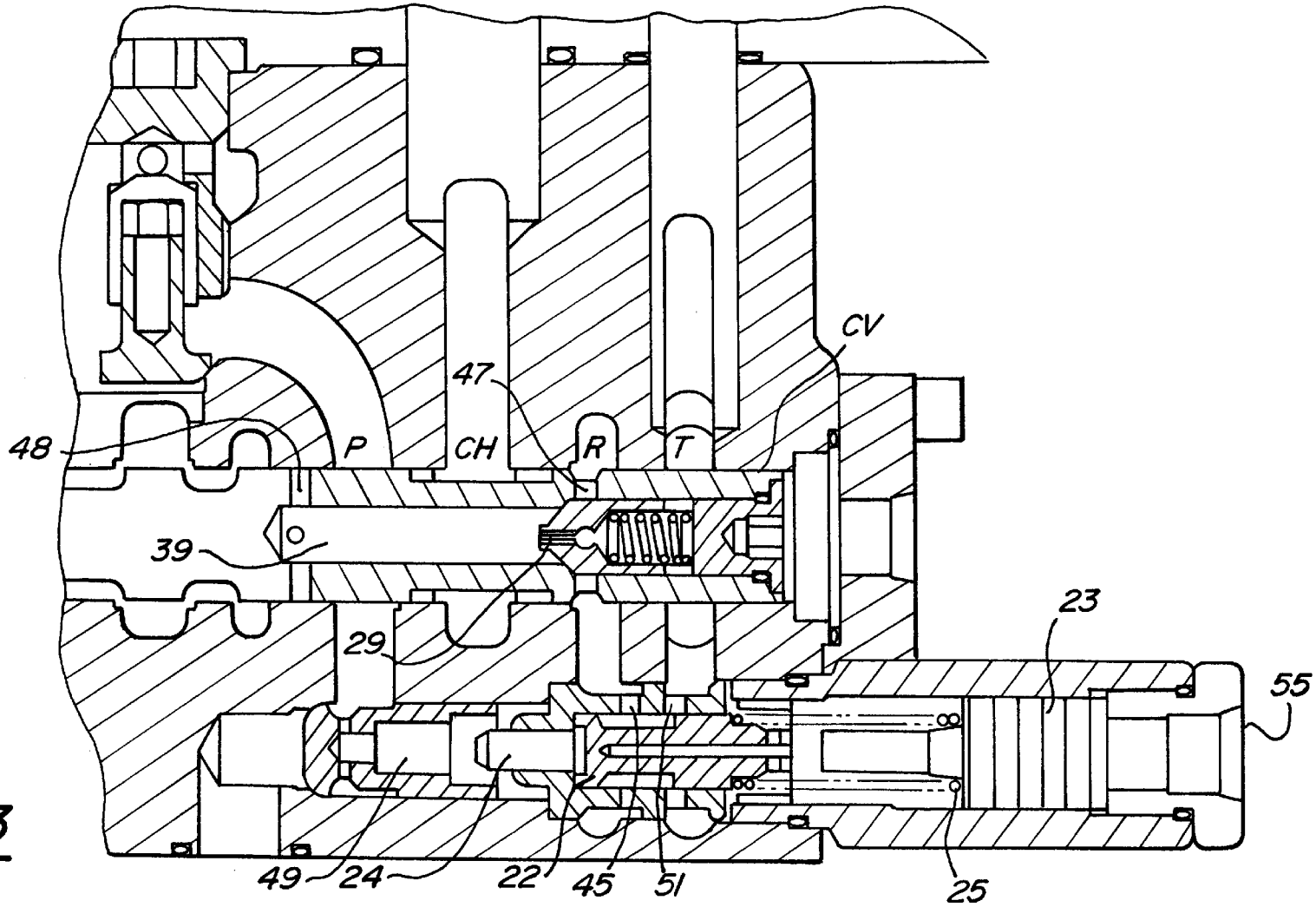
FIG. 3 is a view showing the construction of a variable-regeneration arm control valve in accordance with the preferred embodiment of the present invention.

FIG. 3 is a view showing the construction of a variable-regeneration arm control valve in accordance with the preferred embodiment of the present invention. FIG. 4 is a circuit diagram showing the construction of the hydraulic circuit provided with the variable-regeneration arm control valve of FIG. 3.

As shown in FIGS. 3 and 4, the variable-regeneration control valve CV of this invention has a fluid line 101*b* which extends from the small chamber of the arm cylinder ARM. The valve CV also has a return passage CH and a tank passage T which are selectively connected together in accordance with the linear movement of a spool inside a valve block of the valve CV. A regeneration passage R is connected between the above passages CH and T. The regeneration passage R has a check valve 29 which prevents the reverse flow of fluid from the supply passage P to the return passage CH through the regeneration passage R. A regeneration switching spool 22 is movably arranged between the regeneration passage R and the tank passage T and controls the cross-sectional area of the fluid passage inside the valve CV. The above spool 22 linearly moves in the valve block by the relation between the self pressure inside a fluid line 20, extending from a pump to the supply passage P, and the opposite pressure caused by elasticity of a valve spring 25, thus controlling the amount of regenerated fluid.

In the variable-regeneration control valve CV, the switching pressure of the spool 22 is influenced by the opposite pressure of the valve spring 25. The control valve CV has a pressure control means, which controls the opposite pressure caused by elasticity of the valve spring 25. The opposite pressure acts on one end of the regeneration switching spool 22, while the self pressure (hydraulic pressure of pressurized fluid output from the pump) acts on the other end of the regeneration switching spool 22 and thereby moves the spool 22. In the preferred embodiment, the pressure control means comprises a piston 23, which is provided on an end of the valve spring 25 and moves in response to an outside control signal 55, thereby appropriately changing the opposite pressure of the valve spring 25.

The outside control signal 55 is applied to the pressure control piston 23 through an electronic proportional control valve 26 which outputs pressurized fluid in proportion to a current amount of an input signal. The piston 23 thus continuously moves.

The operational effect of the above variable-regeneration arm control valve CV will be described hereinbelow.

When the arm control valve CV is switched into the first position I in response to an outside control signal 31, the spool 22 of the valve CV moves to the right in FIGS. 3 and 4.

In the above state, the return fluid from the arm cylinder ARM is fed to the regeneration passage R through the return passage CH. In the above state, an orifice effect of an appropriate orifice cross-sectional area is formed between the lines 45 and 51, which connect the regeneration passage R to the tank passage T. A pressure is thus formed in the regeneration passage R. Therefore, the return fluid in the lines 45 and 51 is partially fed back to the cylinder ARM through a regeneration line 47, check valve 29 and fluid lines 48 and 49, thus acting on the piston 24. Thus, both the self pressure, acting on the piston 24, and the opposite pressure caused by elasticity of the valve spring 25 act on the regeneration switching spool 22. In the above operation, the opposite pressure caused by elasticity of the valve spring 25 is changed by the pressure control piston 23 which is operated by the variable outside control signal 55.

When the self pressure, acting on the piston 24, is higher than the opposite pressure caused by the variable elasticity of the valve spring 25, the self pressure pushes the regeneration switching spool 22 to the right in FIG. 3 thereby removing the orifice effect from the valve CV. The pressure in the regeneration passage R is thus reduced and thereby reduces or completely cancels the amount of regenerated fluid which is fed back to the supply passage P. The return fluid from the cylinder ARM in the above state returns to the tank T through the return passage CH.

On the other hand, the moving speed of the arm cylinder ARM can be increased as follows. That is, the pilot pressure acting on the piston 23 is increased, thus increasing the opposite pressure caused by the elasticity of the valve spring 25. When the self pressure acting on the piston 24 is lower than the opposite pressure, the regeneration switching spool 22 is maintained in its original position due to the opposite pressure caused by elasticity of the valve spring 25, thus increasing the amount of return fluid which is fed back to the supply passage P.

As described above, the present invention provides a variable-regeneration directional control valve used in a hydraulic circuit of a construction vehicle. The directional control valve of this invention has a means for controlling the opposite pressure caused by elasticity of a valve spring.

The opposite pressure acts on one end of a regeneration switching spool, while a self pressure (hydraulic pressure of pressurized fluid output from a pump) acts on the other end of the regeneration switching spool and thereby moves the spool.

The directional control valve thus controls the regeneration canceling pressure, so that the control valve can increase the regeneration canceling pressure by increasing the current amount of a variable outside control signal thereby forcibly regenerating the return fluid during an excavating work of a power excavator. Therefore, the control valve increases the amount of pressurized fluid for an actuator by the regenerated fluid thereby increasing the moving speed of the actuator during the excavating work. Meanwhile, the control valve also can reduce the regeneration canceling pressure and thereby reduce the pressure loss caused by a back pressure formed in the return line. The control valve in the above state increases the excavating power of the excavator during an excavating work.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A variable-regeneration directional control valve used in a hydraulic circuit of a construction vehicle, comprising a regeneration passage connected between a return passage and a tank passage, a check valve provided on said regeneration passage for preventing the reverse flow of fluid from a supply passage to the return passage through said regeneration passage, a regeneration switching spool movably arranged in a valve block between said regeneration passage and said tank passage in order to control a cross-sectional area of the fluid passage inside the control valve, said spool linearly moving in the valve block by the relation between a self pressure inside a supply line and an opposite pressure caused by elasticity of a valve spring, thus controlling the amount of regenerated fluid, further comprising:

means for linearly moving in said control valve in response to an outside control signal and appropriately changing the opposite pressure caused by elasticity of the valve spring and thereby controlling a regeneration canceling pressure, said means being provided an end tip of said valve spring determining a switching pressure of said spool.

2. The variable-regeneration directional control valve according to claim 1, wherein said means comprises a pressure control piston, said piston receiving said outside control signal through an electronic proportional control valve and thereby continuously moving, said electronic proportional control valve outputting pressurized fluid in proportion to a current amount of said outside control signal.

3. A hydraulic directional control valve, comprising:

a supply passage;

a return passage;

a tank passage;

a regeneration passage in communication with said return passage and said tank passage;

a check valve disposed in said regeneration passage for preventing reverse flow of fluid from said supply passage to said return passage through said regeneration passage;

a valve block;

a regeneration switching spool slidably disposed in said valve block, said spool being in communication with said regeneration passage and said tank passage for controlling the amount of regeneration fluid flow in said control valve; and a pressure control device actuating said regeneration switching spool in response to a variable outside control signal.

4. The hydraulic directional control valve of claim 3 wherein said pressure control device comprises:

an electronic proportional control valve, said electronic proportional control valve outputting pressurized fluid in proportion to a current amount of said variable outside control signal;

a valve spring having a first end and a second end, said first end in communication with said regeneration switching spool; and a pressure control piston acting on said second end of said valve spring, said piston receiving said pressurized fluid from said electronic proportional control valve;

whereby said piston is continously actuated in response to a desired amount of a regeneration cancelling pressure.

* * * * *